US009556846B2

(12) United States Patent
Straka et al.

(10) Patent No.: US 9,556,846 B2
(45) Date of Patent: Jan. 31, 2017

(54) ENGINE IGNITION SHUTDOWN MODULE

(71) Applicant: Deere & Company, Moline, IL (US)

(72) Inventors: David A. Straka, Willow Spring, NC (US); Quintin D. Rigert, Cary, NC (US); Jason D. Raabe, Raleigh, NC (US); Allan D. Narveson, Holly Springs, NC (US)

(73) Assignee: DEERE & COMPANY, Moline, IL (US)

( * ) Notice: Subject to any disclaimer, the term of this patent is extended or adjusted under 35 U.S.C. 154(b) by 840 days.

(21) Appl. No.: 13/793,692

(22) Filed: Mar. 11, 2013

(65) Prior Publication Data

US 2014/0251271 A1 Sep. 11, 2014

(51) Int. Cl.
*F02P 11/02* (2006.01)

(52) U.S. Cl.
CPC ..... *F02P 11/025* (2013.01)

(58) Field of Classification Search
CPC ..... F02P 11/025
USPC ..... 123/406.56, 406.57
IPC ..... F02P 11/025
See application file for complete search history.

(56) References Cited

U.S. PATENT DOCUMENTS 3,762,383 A * 10/1973 Richards ..... F02P 9/005 123/335
4,111,175 A 9/1978 Nakamura et al.
4,153,850 A * 5/1979 Boyer ..... F02P 7/067 123/614
4,368,717 A * 1/1983 Roberts ..... F02P 11/025 123/146.5 D
4,369,745 A * 1/1983 Howard ..... B60K 28/00 123/198 DC
4,402,298 A * 9/1983 Morita ..... F02P 1/08 123/406.56
4,459,951 A * 7/1984 Tobinaga ..... F02B 77/089 123/198 DC
4,509,493 A * 4/1985 Nash ..... F02P 1/086 123/406.57
4,566,425 A * 1/1986 Nitou ..... F02P 1/086 123/406.57
4,697,570 A * 10/1987 Ionescu ..... F02P 1/086 123/406.57
4,976,234 A * 12/1990 Okuda ..... F02D 17/04 123/198 D
5,138,995 A * 8/1992 Erhard ..... F02P 1/086 123/335
5,433,184 A * 7/1995 Kinoshita ..... F02P 15/08 123/406.57
5,526,785 A * 6/1996 Masters ..... F02P 1/086 123/198 DC
5,584,280 A * 12/1996 Kinoshita ..... F02P 1/086 123/406.57

(Continued)

*Primary Examiner* — Joseph Dallo

(57) ABSTRACT

An engine ignition shutdown module includes a voltage regulator circuit connected to a key switch, and a pair of isolated MOSFET driver circuits connected to the voltage regulator circuit. Each MOSFET driver circuit charges a capacitor while the key switch is in a run position and the interlock switches are closed, and each capacitor discharges through a resistor for a time delay period once the key switch is moved from the run position to an off position or at least one of the interlock switches are opened. A pair of high voltage output MOSFET transistors are switched on while the capacitors discharge and provide an output to a magneto ignition for the time delay period.

10 Claims, 2 Drawing Sheets

(56) References Cited

U.S. PATENT DOCUMENTS 6,123,063 A * 9/2000 Boerjes ..... F02P 3/0435 123/598
6,196,208 B1 * 3/2001 Masters ..... F02D 31/008 123/597
6,205,395 B1 * 3/2001 Young ..... F02P 5/02 701/115
6,272,428 B1 * 8/2001 Heath ..... F02P 7/10 123/406.6
6,339,743 B1 * 1/2002 Young ..... F02P 7/10 701/115
6,353,293 B1 * 3/2002 Frus ..... F02P 3/0869 123/406.57
6,478,010 B2 * 11/2002 Kiessling ..... F02P 1/086 123/335
6,575,134 B1 * 6/2003 Bowling ..... F02D 31/001 123/149 D
7,145,324 B2 * 12/2006 Masters ..... G01P 3/4807 324/166
7,224,088 B2 5/2007 Shoemaker et al.
7,397,207 B2 * 7/2008 Sun ..... F02B 33/32 123/335
7,520,264 B2 4/2009 Straka
7,631,633 B2 * 12/2009 Sasaki ..... F02P 1/086 123/406.57
8,323,153 B2 * 12/2012 Deblack ..... B60T 7/12 477/204
8,584,651 B1 * 11/2013 Martinson ..... F02P 9/005 123/406.58
2004/0255901 A1 * 12/2004 Yamashita ..... F02P 1/086 123/335
2008/0022971 A1 * 1/2008 Straka ..... F02P 1/08 123/406.57
2008/0178841 A1 * 7/2008 Andersson ..... F02P 3/0815 123/406.57
2008/0276905 A1 * 11/2008 Czimmek ..... F02P 3/0838 123/406.57
2008/0316670 A1 * 12/2008 Matsuura ..... F02D 41/20 361/152
2010/0031942 A1 * 2/2010 Lepley ..... F02P 3/093 123/605

* cited by examiner

ENGINE IGNITION SHUTDOWN MODULE

FIELD OF THE INVENTION

This invention relates to magneto equipped gas combustion engines, and more specifically to a module that shuts down the ignition for such engines.

BACKGROUND OF THE INVENTION

Magneto equipped gas combustion engines are commonly used to provide traction drive for grass mowing equipment, off road vehicles or other machines. During the typical shutdown of the ignition system and fuel source for these engines, there may be a period of time when excess fuel may not be ignited properly and burned. This occurs because the ignition signal typically may be grounded at the same time as the fuel source is shut off. Excess fuel may pass to the exhaust system where it may ignite and cause an afterbang condition also known as backfire.

U.S. Pat. No. 7,520,264 relates to an ignition circuit designed to provide a time delayed, electrical ground of the magneto signal. This circuit utilizes a triad for alternating current (TRIAC) which may be prone to self-triggering when subjected to fast changing high voltage signals which are very common with magneto signal based ignition systems. For that reason, these circuits cannot effectively support low voltage ignition signals. Additionally, these circuits continuously draw power from the ignition signal (magneto) to create the signal that is used to trigger the TRIAC in the circuit. Drawing power from the magneto signal can negatively impact the engine's performance.

There is a need for an engine ignition shutdown module that can control the time delay between the enabling and disabling of an ignition system and fuel source for an internal combustion engine. There is a need for an engine ignition shutdown module that can interface to high and low voltage, low current signals. There is a need for an engine ignition shutdown module that can reduce or minimize the power from the ignition signal used to perform its functions.

SUMMARY OF THE INVENTION

An engine ignition shutdown module includes a MOSFET driver circuit charging a capacitor while a key switch is in a run position. The capacitor discharges through a resistor connected to a MOSFET transistor that is turned on if an interlock switch is open or the key switch is moved from the run position to an off position, and the MOSFET driver circuit discontinues charging the capacitor. The MOSFET transistor may be connected to an engine magneto to provide ignition while the capacitor discharges. The engine ignition shutdown module can control the time delay between the enabling and disabling of an ignition system and fuel source for an internal combustion engine. The engine ignition shutdown module can interface to high and low voltage, low current signals, and can reduce or minimize the power from the ignition signal used to perform its functions.

DESCRIPTION OF THE PREFERRED EMBODIMENT

Figure 1:
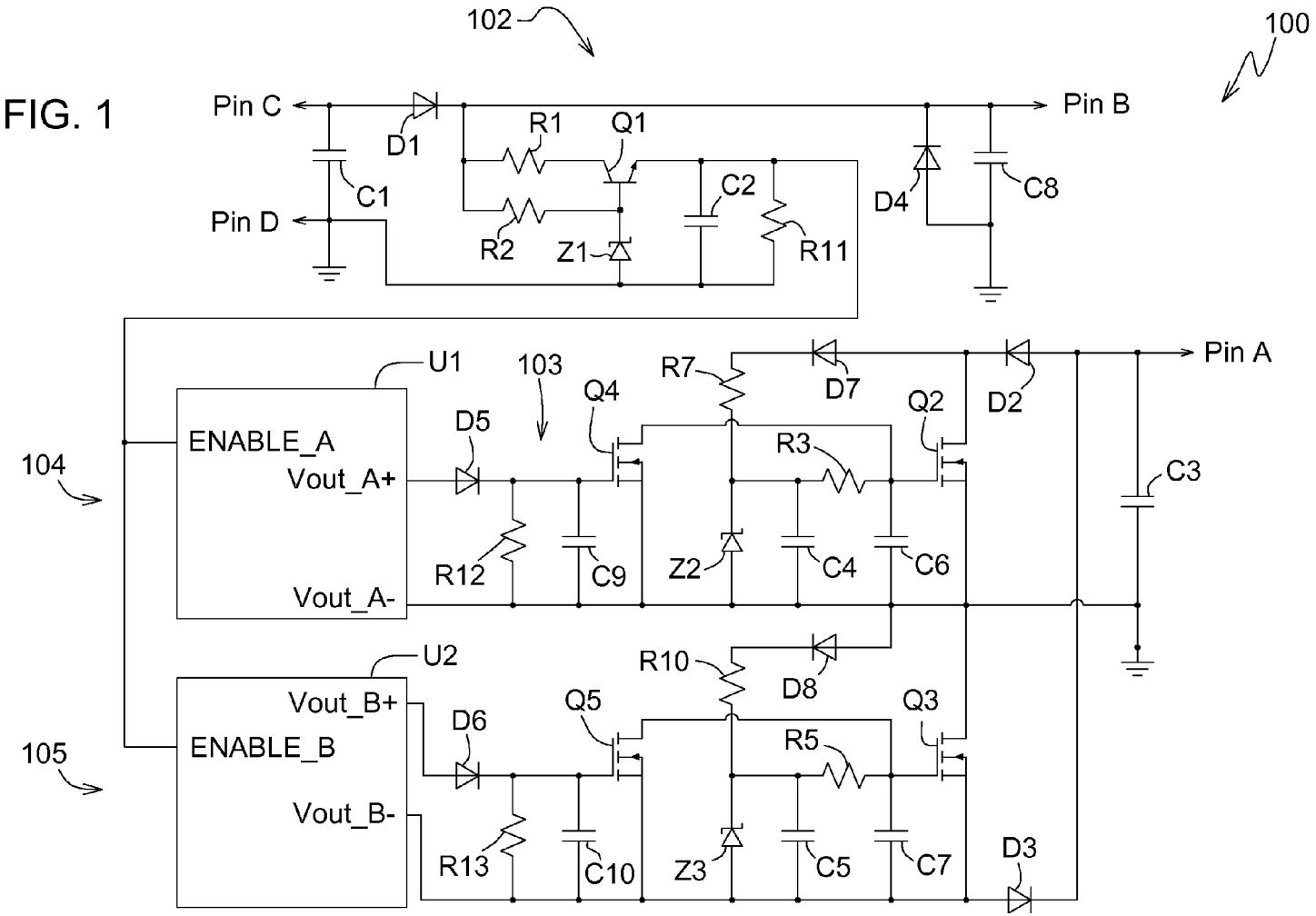
FIG. 1 is a schematic diagram of an engine ignition shutdown module according to a first embodiment of the invention.

In a first embodiment shown in FIG. 1, engine ignition shutdown module 100 may comprise a semiconductor circuit that can delay grounding of an ignition signal with respect to disabling a fuel sourcing device for an internal combustion engine. The first embodiment may be particularly useful for low cost gas powered engines that do not include or require an electronic engine control module, such as engines for grass mowing equipment, off road vehicles or other machines. The engine ignition shutdown module may be a stand alone circuit or unit capable of operating with either positive or negative ignition signals.

In a first embodiment, engine ignition shutdown module 100 may have four electrical connections or pins A-D. For example, connection pin C may be connected to a battery or power input signal in the range of about 9 to 16 VDC, and preferably 12 VDC. For example, the power input signal may originate from a switched 12 VDC line from the machine's key switch. This power input signal to pin C also may be connected through various interlock switches (not shown) that provide vehicle safety interlocks. For example, the interlock switches may include a vehicle seat switch and/or park brake switch used as vehicle interlocks for safe operation. Connection pin A may be an output signal to ignition. For example, connection pin A may interface directly with the engine's ignition signal, typically a high voltage magneto signal. When the output of connection pin A is off, the pin will float. When the output is on, connection pin A will be grounded. Connection pin B may be an output signal that provides switched 12 V to a fuel solenoid or other fuel sourcing device which are generally known to those skilled in the art. Connection pin D may be to electrical ground. For example, connection pin D may be connected to the ground terminal of the vehicle's power source, such as a battery's negative terminal.

In a first embodiment, engine ignition shutdown module 100 may include voltage regulator circuit 102, at least one MOSFET driver circuit 104 (and preferably a pair of isolated MOSFET driver circuits 104, 105 to provide reverse polarity protection), time delays provided by resistors R12, R13 and capacitors C9, C10, and two high voltage output MOSFET transistors Q2, Q3.

In a first embodiment, voltage regulator circuit 102 may provide a 5 VDC power supply. The voltage regulator circuit may include capacitor C1 connected between pin C and pin D or ground. Resistors R1, R2 may be connected between high current diode D1 and the collector and base of transistor Q1 respectively. Diode Z1 may be connected between pin D or ground and the base of transistor Q1. Capacitor C2 and resistor R11 may be connected in parallel between the emitter of transistor Q1 and pin D or ground. Flyback diode D4 and capacitor C8 may be connected in parallel between pin B and ground.

In a first embodiment, the gate or enable pin of isolated MOSFET driver U1 may be connected to the emitter of transistor Q1. Diode D5 may be connected between Vout pin A+ of MOSFET driver U1 and the gate of transistor Q4. Resistor R12 and capacitor C9 may be connected in parallel between diode D5 and Vout pin A− of MOSFET driver U1 or ground. The source of transistor Q4 also may be connected to Vout pin A− or ground. Capacitor C6 may be connected between the drain of transistor Q4 and Vout pin A− or ground. Diode D2 may be connected between pin A and the drain of output MOSFET transistor Q2. Diode D7 may be connected between the drain of output MOSFET transistor Q2 and resistor R7. Resistor R7 may be connected between diode D7 and diode Z2, capacitor C4 and resistor R3. Diode Z2 and capacitor C4 may be connected in parallel between resistors R7, R3 and Vout pin A− or ground. Resistor R3 may be connected between resistor R7, diode Z2 and capacitor C4 and the gate of output MOSFET transistor Q2. The drain of transistor Q4 also may be connected to the gate of output MOSFET transistor Q2. Capacitor C6 may be connected between the gate of output MOSFET transistor Q2 and Vout pin A− or ground. The source of output MOSFET transistor Q2 also may be connected to Vout pin A− or ground. Capacitor C3 may be connected between pin A and Vout pin A− or ground.

In a first embodiment, the gate or enable pin of isolated MOSFET driver U2 may be connected to the emitter of transistor Q1. Diode D6 may be connected between Vout pin B+ of MOSFET driver U2 and the gate of transistor Q5. Resistor R13 and capacitor C10 may be connected in parallel between diode D6 and Vout pin B− of MOSFET driver U2 or ground. The source of transistor Q5 also may be connected to Vout pin B−. Capacitor C7 may be connected between the drain of transistor Q5 and Vout pin B−. Diode D8 may be connected between Vout pin A− or ground Q2 and resistor R10. Resistor R10 may be connected between diode D8 and diode Z3, capacitor C5 and resistor R5. Diode Z3 and capacitor C5 may be connected in parallel between resistors R10, R5 and Vout pin B−. Resistor R5 may be connected between resistor R10, diode Z3 and capacitor C5 and the gate of output MOSFET transistor Q3. The drain of transistor Q5 also may be connected to the gate of output MOSFET transistor Q3. Capacitor C7 may be connected between the gate of output MOSFET transistor Q3 and Vout pin B−. The source of output MOSFET transistor Q2 also may be connected to Vout pin B−. Diode D3 may be connected between the source of output MOSFET transistor Q3 and pin A.

In a first embodiment, when 12 VDC is applied through a key switch to pin C, voltage may be applied to fuel solenoid output (pin B) through high current diode D1. Voltage also may be applied to voltage regulator circuit 102 which creates a 5 VDC power supply. The 5 VDC power supply may power/enable isolated MOSFET drivers U1, U2. When power is applied to isolated MOSFET drivers U1 and U2, their outputs may create voltages that are close to 10 VDC. The output voltages from U1 and U2 may charge capacitors C9 and C10 and turn on small signal MOSFET transistors Q4 and Q5. Time delays are created in the circuit based on resistors R12 and R13, and capacitors C9 and C10. The time delays may be used to control the shutdown of the output devices. With transistors Q4 and Q5 turned on, output MOSFET transistors Q2 and Q3 may be kept in the off state and do not conduct any current. This allows the ignition signal to operate freely while the key switch is in the on or run position and the interlock switches are closed.

In a first embodiment, when the key switch is turned from the on or run position to the off position, or an interlock switch is opened, removing 12 VDC from pin C, voltage also is removed from fuel solenoid output (pin B). Flyback diode D4 may protect the circuit from voltage spikes. Voltage also is removed from voltage regulator circuit 102, which shuts off the 5 VDC power supply to MOSFET driver circuits 104, 105. Removal of the 5 VDC power supply will disable isolated MOSFET drivers U1, U2. When power is removed from isolated MOSFET drivers U1, U2, their outputs shut off and their voltages at pins Vout A+ or Vout B+ go to 0 VDC, but the small signal MOSFET transistors Q4 and Q5 will remain turned on. This is how a time delay may be provided. Capacitors C9 and C10 were charged when the key switch was on and the interlock switches were closed, and begin discharging through resistors R12 and R13 when the key switch is off or an interlock switch is open. After the capacitors C9 and C10 have partially discharged and the voltages across them are low enough, transistors Q4 and Q5 turn off. When transistors Q4 and Q5 turn off, capacitors C4 and C5 become effectively connected to the inputs or gates of output MOSFET transistors Q2 and Q3. This will cause the output MOSFET transistors Q2 and Q3 to be in an on state and start to conduct current for a short period of time, and cause the ignition signal to be grounded through transistors Q2 and Q3.

Figure 2:
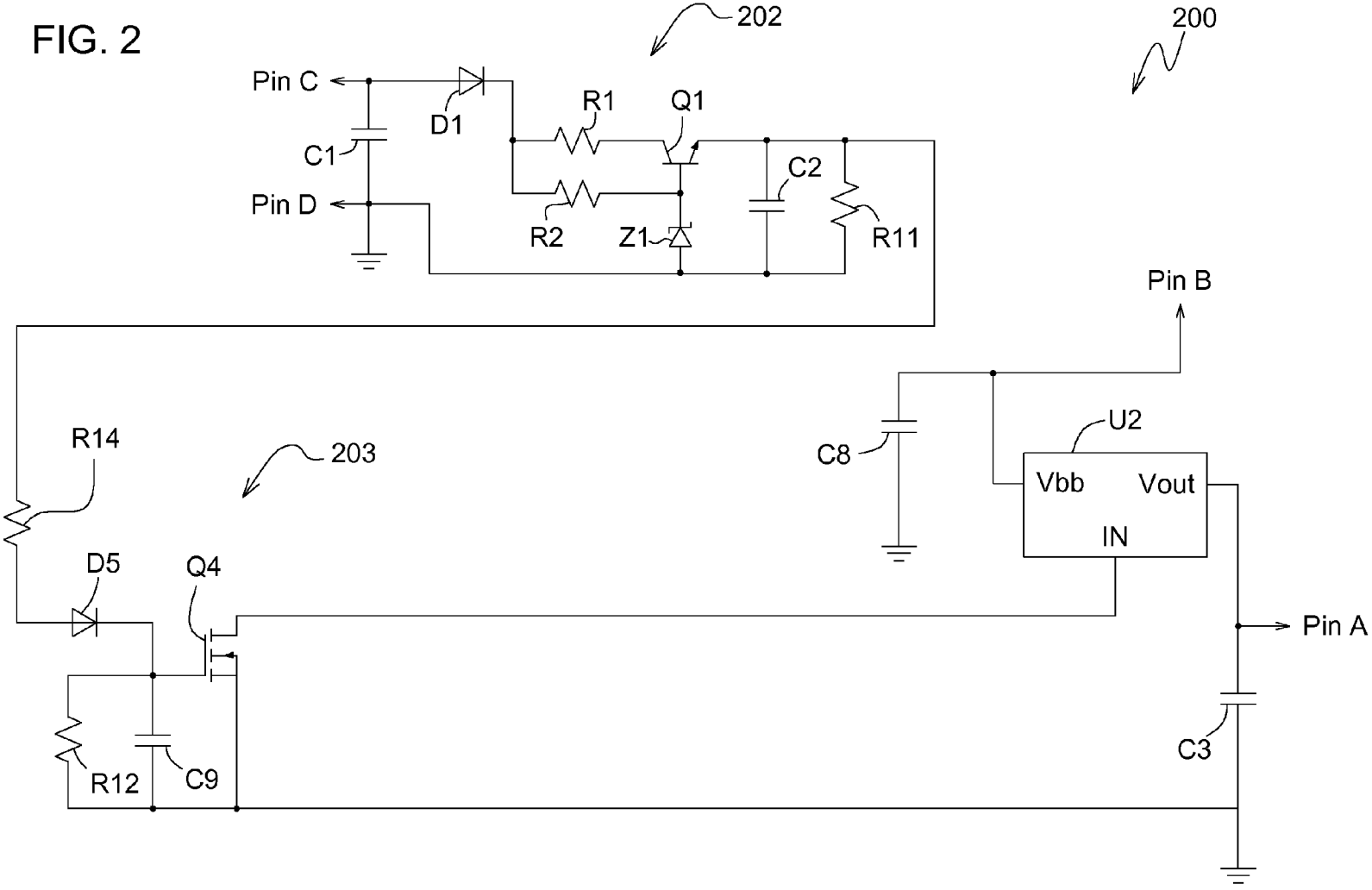
FIG. 2 is a schematic diagram of an engine ignition shutdown module according to a second embodiment of the invention.

In a second embodiment shown in FIG. 2, engine ignition shutdown module 200 may be used with a gas combustion engine having an electronic engine control module. Engine ignition shutdown module 200 may retain a battery voltage signal to an input of the electronic engine control module after the key switch has been turned from the run or on position to the off position, or one or more interlock switches is open. The engine ignition shutdown module allows the ignition to continue to operate for a set time after sourcing to the fuel system has been removed.

In a second embodiment, engine ignition shutdown module 200 may use a resistive/capacitive timing circuit and a PROFET power switch U2 to extend or retain a battery signal for a set time to the engine control module after switched battery power is removed. The engine control module then may control the shutdown process once the extended signal is removed.

In a second embodiment, engine ignition shutdown module 200 may accept an external signal from a switched battery to power a timing circuit that allows for an extended direct battery output voltage to be present at a specified input of the electronic engine control module. The engine ignition shutdown module also may allow for a discrete signal, either 0 V or direct battery voltage, into a specified input of the engine control module. This helps to eliminate any noise that may cause false readings to the electronic engine control module found in the switched battery voltage used by other components.

In a second embodiment, engine ignition shutdown module 200 may include four electrical connections or pins A-D. Pin A may be an output signal that interfaces directly with an ignition input of the electronic engine control module. Pin B may be a direct battery voltage input, connected directly to a 12V battery source. Pin C may be a switched battery voltage input, connected through the ignition switch and one or more safety interlocks to the battery source. Pin D may be connected to electrical ground.

In a second embodiment, voltage regulator circuit 202 may provide a 5 VDC power supply that functions the same or substantially the same as voltage regulator circuit 102 shown in the first embodiment. The voltage regulator circuit may include capacitor C1 connected between pin C and pin D or ground. Resistors R1, R2 may be connected between high current diode D1 and the collector and base of transistor Q1 respectively. Diode Z1 may be connected between pin D or ground and the base of transistor Q1. Capacitor C2 and resistor R11 may be connected in parallel between the emitter of transistor Q1 and pin D or ground.

In a second embodiment, the timing circuit 203 is same or substantially the same as timing circuit 103 of the first embodiment. Resistor R14 may be connected between the diode D5 and the emitter of transistor Q1. Diode D5 may be connected between resistor R14 and the gate of transistor Q4. Resistor R12 and capacitor C9 may be connected in parallel between diode D5 and ground. The source of transistor Q4 also may be connected to ground.

In a second embodiment, when 12 VDC is applied to pin C, voltage may be applied to voltage regulator circuit 202. This creates a 5 VDC power supply. The 5V power supply may charge capacitor C9 and turn on small signal MOSFET transistor Q4. The circuit may be used to provide time delays based on resistor R12 and capacitor C9. These delays may be used to control the shutdown of the output devices. With transistor Q4 turned on, the input to PROFET power switch U2 is tied to ground which activates the switch. While the switch is on, 12V direct battery may be fed through switch to output pin A. This provides a voltage signal that may be read by a specified input on the electronic engine control module.

In a second embodiment, when 12 VDC is removed from pin C, the switched battery voltage is removed from voltage regulator circuit. This shuts off the 5 VDC power supply. When the 5 VDC power supply is turned off, its output will go to 0 VDC, but the small signal MOSFET transistor Q4 will remain turned on. A time delay may be created because charged capacitor C9 may begin discharging through resistor R12. When the voltage across capacitor C9 is low enough, transistor Q4 will turn off. With transistor Q4 turned off, the input signal to power switch U2 will float. This will turn off the power switch, forcing the output of pin A to the engine control unit to be grounded by the pull down resistor in the ECU. This will remove the voltage signal form the ECU.

Having described the preferred embodiment, it will become apparent that various modifications can be made without departing from the scope of the invention as defined in the accompanying claims.

The invention claimed is:

1. An engine ignition shutdown module comprising:

a MOSFET driver circuit charging a capacitor while a power input signal is provided through a key switch in a run position and at least one interlock switch that is closed;

the capacitor discharging through a resistor connected to a MOSFET transistor that is turned on after the power input signal is removed and the MOSFET driver circuit discontinues charging the capacitor;

the MOSFET transistor providing voltage signals to an ignition input while the capacitor discharges after removing voltage signals to a fuel sourcing system.

2. The engine ignition shutdown module of claim 1 further comprising a pair of MOSFET driver circuits.

3. The engine ignition shutdown module of claim 1 further comprising a voltage regulator circuit providing a regulated voltage to the MOSFET driver circuit while a key switch is in a run position.

4. The engine ignition shutdown module of claim 3 wherein the voltage regulator circuit discontinues providing a regulated voltage when the key switch is moved from the run position to the off position.

5. An engine ignition shutdown module comprising:

a timing circuit receiving a power input signal from a battery and providing a power output signal to a fuel sourcing device, the timing circuit including a capacitor that is charged by the battery and discharges through a resistor and providing a voltage signal to a specified input of an electronic engine control module after the power input signal has been removed from the engine ignition shutdown module and the power output signal is removed to the fuel sourcing device; and a MOSFET transistor connected to the timing circuit and providing an input signal to a power switch for an engine ignition control for a period of time while the capacitor discharges.

6. The engine ignition shutdown module of claim 5 further comprising a voltage regulator circuit providing a power supply to charge the capacitor.

7. The engine ignition shutdown module of claim 6 further comprising a small signal MOSFET transistor that is turned on while the power input signal is provided to the engine ignition shutdown module, and remains turned on for a period of time after the power input signal is removed from the engine ignition shutdown module.

8. The engine ignition shutdown module of claim 6 further comprising a PROFET power switch.

9. An engine ignition shutdown module comprising:

a first connection pin to a power supply with a voltage regulator circuit connected to a key switch;

a second connection pin to a magneto ignition or an engine control module;

a third connection pin to a fuel sourcing device;

a pair of isolated MOSFET driver circuits connected to the voltage regulator circuit, each MOSFET driver circuit charging a capacitor while the key switch is in a run position and a plurality of interlock switches are closed, each capacitor discharging through a resistor for a time delay period once the key switch is moved from the run position to an off position or at least one interlock switch is opened and a voltage output is removed to the third connection pin to the fuel sourcing device; and a pair of high voltage output MOSFET transistors that are on while the capacitors discharge and have an output to the magneto ignition for the time delay period.

10. The engine ignition shutdown module of claim 9 wherein the voltage regulator circuit provides a 5 VDC power supply.

* * * * *